US005388410A

United States Patent [19]

Momose et al.

[11] Patent Number: 5,388,410

[45] Date of Patent: Feb. 14, 1995

[54] STIRLING ENGINE

[75] Inventors: Yutaka Momose, Anjo; Tetsumi Watanabe, Okazaki; Hiroyuki Ohuchi, Toyoake, all of Japan

[73] Assignee: Aisin Seiki Kabushiki Kaisha, Kariya, Japan

[21] Appl. No.: 217,547

[22] Filed: Mar. 25, 1994

[30] Foreign Application Priority Data

Mar. 29, 1993 [JP] Japan ..... 5-070208

[51] Int. Cl.[6] ..... F01B 29/10

[52] U.S. Cl. ..... 60/526; 60/517

[58] Field of Search ..... 60/517, 526

[56] References Cited

U.S. PATENT DOCUMENTS 2,616,248 11/1952 Brey et al. ..... 60/526
4,753,072 6/1988 Johansson et al. ..... 60/517
5,329,768 7/1994 Moscrip ..... 60/526

FOREIGN PATENT DOCUMENTS 51-10310 4/1976 Japan .
618266 2/1949 United Kingdom ..... 60/526

*Primary Examiner*—Ira S. Lazarus
*Assistant Examiner*—L. Heyman
*Attorney, Agent, or Firm*—Burns, Doane, Swecker & Mathis

[57] ABSTRACT

A Stirling engine includes an expansion cylinder, a compression cylinder, and a plurality of conduits which each extend between and connect the expansion cylinder and the compression cylinder. A plurality of heating portions are provided, each of which is disposed in one of the conduits in order to be connected with the expansion cylinder. A plurality of cooling portions are also provided, each of which is disposed in one of the conduits in order to be connected with the compression cylinder. A plurality of regenerative portions are also included, each of which is disposed in one of the conduits in order to connect one of the heating portions and one of the cooling portions. Each of the regenerative portions possesses a length according to the temperature of the working fluid in the corresponding heating portion.

12 Claims, 2 Drawing Sheets

STIRLING ENGINE

BACKGROUND OF THE INVENTION

1. Field of the Invention

This invention relates to an engine, and more particularly to the structure of a Stirling engine.

2. Description of the Related Art

A conventional. Stirling engine is disclosed in U.S. Pat. No. 4,753,072. The Stirling engine disclosed in this document includes a condenser having a plurality of tubes provided in a housing, a regenerator and a cooler which are disposed between an expansion cylinder, and a compression cylinder. Each of the tubes of the condenser has a working gas, such as helium, located therein. Further, the condenser has sodium between the bundle of tubes and the housing. The sodium is heated and vaporized by an evaporator, and flows into the condenser in order to heat the working gas in the tubes.

However, in the above-described device, since the Stirling engine is provided with only one cooler, the working gas is ineffectively cooled down in the cooler.

Another Stirling engine, which is disclosed in Japanese Patent No. 51(1976)-10310, includes a heating tube, a regenerative portion and a plurality of cooling tubes. However, in this device, the working gas is ineffectively heated in the heating tube since the structure comprises only one heating tube.

To overcome the aforementioned problems, a Stirling engine can be constructed to include a plurality of heating devices and a plurality of cooling devices. However, this Stirling engine suffers from the drawback that the working gas flowing in all of the heating devices cannot be equally heated since all of the heating devices cannot equally receive the heat from a heat source due to the location of the heating devices in relation to the heat source. That is, the working gas flowing in the heating device located at a near position to the heat source is sufficiently heated by the heat source, but the working gas flowing in other heating devices disposed at distant positions from the heat source are insufficiently heated.

All of the unequally heated working gas flows into the regenerator, into each of the cooling devices and, as a result, into the compression cylinder. Thus, thermal energy of the working gas cannot efficiently be transformed into motive energy. That is, because the Stirling engine comprises only one regenerator, the measurement of the regenerator (such as the diameter or the length) cannot be adjusted according to the unequally heated working gas in each of the heating devices. Therefore, the Stirling engine is not able to increase the output torque.

SUMMARY OF THE PRESENT INVENTION

It is an object of the present invention to provide a Stirling engine which can efficiently transform thermal energy into motive energy.

It is another object of the present invention to provide a Stirling engine which can efficiently heat and cool the working gas.

It is further object of the present invention to provide a Stirling engine which can be conveniently manufactured.

It is a further object of the present invention to provide a Stirling engine which is durable.

It is a further object of the present invention to provide a Stirling engine which is simple in structure and small in size.

It is a further object of the present invention to provide a Stirling engine which is low in cost.

To achieve at least the above mentioned objects, a Stirling engine in accordance with this invention comprises an expansion cylinder, a compression cylinder, a plurality of conduits each of which connects the expansion cylinder and the compression cylinder, a plurality of heating portions each of which is disposed in one of the conduits in order to be connected with the expansion cylinder, a plurality of cooling portions which are each disposed in one of the conduits in order to be connected with the compression cylinder, and a plurality of regenerative portions which are each disposed in one of the conduits in order to connect each of the heating portions and each of the cooling portions, wherein measurement of each of the regenerative portions is adjusted according to a temperature of the corresponding heating portion.

BRIEF DESCRIPTION OF THE DRAWING FIGURES

The features and advantages of the Stirling engine according to the present invention will be more clearly appreciated from the following description in conjunction with the accompanying drawings in which like elements bear like reference numerals and wherein.

DETAILED DESCRIPTION OF PREFERRED EMBODIMENTS OF THE INVENTION

Figure 1:
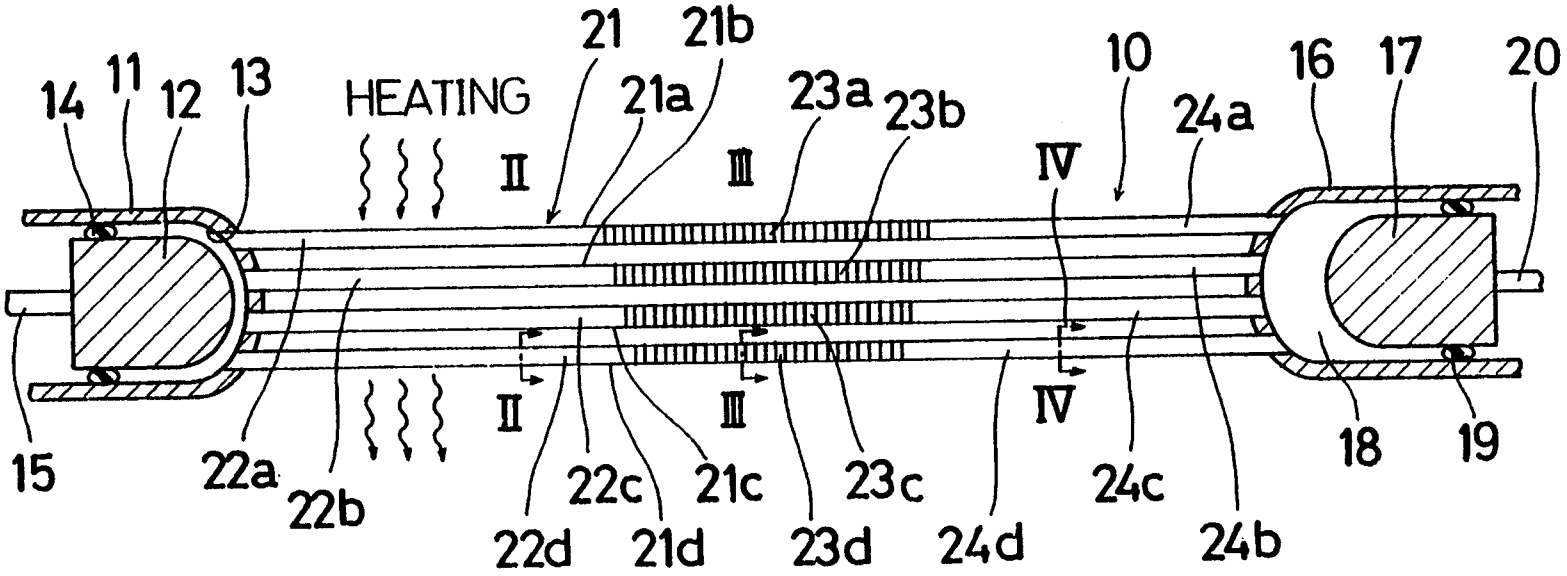
FIG. 1 is a cross-sectional view of a Stirling engine of the present invention.

Referring to FIG. 1, a 2-piston type Stirling engine 10 comprises an expansion cylinder 11 and an expansion piston 12. The expansion piston 12 is disposed in the expansion cylinder 11 to slide in the horizontal direction of FIG. 1. The expansion piston 12 forms an expansion chamber 13 with the expansion cylinder 11. A piston ring 14 is disposed between the expansion piston 12 and a side portion of the expansion cylinder 11. The expansion piston 12 is connected to a crank shaft (not shown in the drawing figures) through a rod 15.

The Stirling engine 10 also includes a compression cylinder 16 and a compression piston 17. The compression piston 17 is disposed in the compression cylinder 16 to slide in the horizontal direction of FIG. 1. The compression piston 17 forms a compression chamber 18 within the compression cylinder 16. A piston ring 19 is disposed between the compression piston 17 and a side portion of the compression cylinder 16. The compression piston 17 is connected to a crank shaft (not shown) through a rod 20 so as to provide a phase difference with respect to the movement of the compression piston 17 relative to that of the expansion piston 12.

A plurality of conduits 21 (four conduits are shown in the FIG. 1) are connected to both the expansion cylinder 11 and the compression cylinder 16 to interconnect the expansion chamber 13 and the compression chamber 18. In each of the conduits 21, a heating portion 22, a regenerative portion 23 and a cooling portion 24 are arranged from the side of the expansion chamber 13 to the side of the compression chamber 18. That is, the conduit 21*a* includes a heating portion 22*a*, a regenerative portion 23*a* and a cooling portion 24*a*, the conduit 21*b* includes a heating portion 22*b*, a regenerative portion 23*b* and a cooling portion 24*b*, the conduit 21*c* includes a heating portion 22*c*, a regenerative portion 23*c* and a cooling portion 24*c*, and the conduit 21*d* includes a heating portion 22*d*, a regenerative portion 23*d* and a cooling portion 24*d*. Further, the heating portions 22 are heated by a heat source, such as a burner (not specifically shown in the drawing figures, but schematically depicted by the arrows), located above the heating portions 22. The conduits 21, the expansion chamber 13 and the compression chamber 18 are filled with a working fluid, such as helium.

The length of each of the regenerative portions 23 is established according to the temperature of the working fluid flowing in the corresponding heating portion 22. That is, the higher the temperature of the working fluid flowing in the heating portion 22, the longer the corresponding regenerative portion 23. Because the location at which the heating portion 22*a* is disposed is nearest to the heat source relative to all of the other heating portions 22, the temperature of the fluid in the heating portion 22*a* is higher than that of the other heating portions 22. Further, the temperature of the fluid in each of the heating portions 22 decreases from the heating portion 22*b* to the heating portion 22*d*. Therefore, when the heat source is located above the heating portions 22, the length of the regenerative portion 23*a* is longest, and the length of each successive regenerative portion 23 is reduced from the regenerative portion 23*b* to the regenerative portion 23*d*.

Further the conduits 21 may be connected with the expansion cylinder 11 and the compression cylinder 16 through manifolds.

Figure 2:
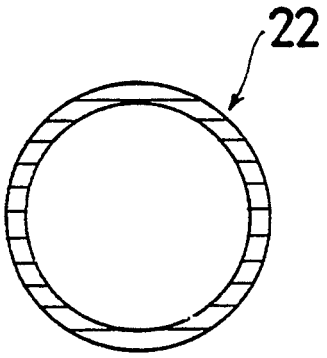
FIG. 2 is a cross-sectional view of a Stirling engine of the present invention taken on line II—II of FIG. 1.

Each of the heating portions 22 includes a hollow area as shown in FIG. 2. The working fluid flowing in the heating portions 22 is heated by the heat source so as to be maintained at a high temperature.

Figure 3:
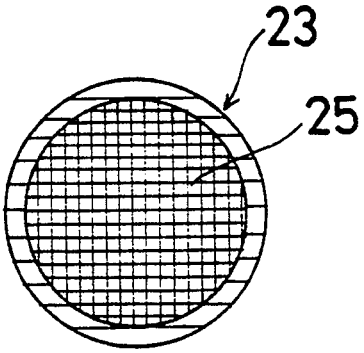
FIG. 3 is a cross-sectional view of a Stirling engine of the present invention taken on line III—III of FIG. 1.
Figure 5:
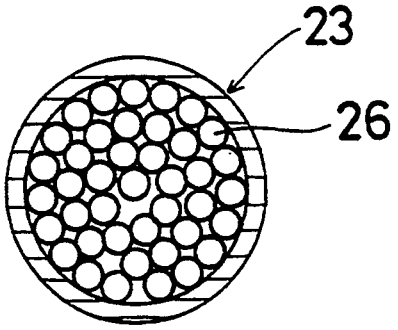
FIG. 5 is a cross-sectional view of a Stirling engine similar to FIG. 3 illustrative of a second embodiment of the present invention.

Each of the regenerative portions 23 includes a dense mesh 25 located therein as shown in FIGS. 1 and 3 to derive the heat from the working fluid flowing into each of the regenerative portions 23 from each of the heating portions 22. Further, each of the regenerative portions 23 regenerates the heat therein. The regenerated heat in each of the regenerative portions 23 is transmitted to the cooled working fluid flowing into each of the regenerative portions 23 from each of the cooling portions 24. As an alternative to the mesh, each of the regenerative portions 23 may include a plurality of tubes 26 that are densely disposed therein as shown in FIG. 5. The tubes 26 are arranged in the direction of flow of the working fluid.

Figure 4:
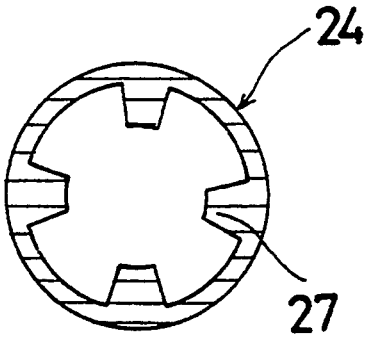
FIG. 4 is a cross-sectional view of a Stirling engine of the present invention taken on line IV—IV of FIG. 1.

As shown in FIG. 4, each of the cooling portions 24 includes a plurality of inwardly extending inner fins 27 that efficiently cool the working fluid flowing therein. Because heat is removed by a cooling means, such as cooling water (not shown in the drawing figures), through the inner fins 27, the working fluid flowing in each of the cooling portions 24 is cooled down.

As shown in FIG. 1, when the heating portions 22 receive heat from the heat source disposed above the heating portions 22, the temperatures of the various heating portions 22 are different from each other because of the difference in quantity of heat applied to each of the heating portions 22. In accordance with the invention, the measurements or dimensions (such as the diameter or the length) of the regenerative portion 23 and the cooling portion 24 can be adjusted according to the temperature of the corresponding heating portion 22 since each of the conduits 21 includes one heating portion 22, one regenerative portion 23 and one cooling portion 24. In the above embodiment of the invention, as the temperature of the working fluid flowing in the heating portion 22 becomes higher, the regenerative portion 23 is set to be longer. A part of the heat supplied to each of the heating portions 22 from the heat source is transformed into motive energy. On the other hand, the rest of the heat is transmitted to each of the cooling portions 24 through the corresponding regenerative portion 23 whose length has been adjusted according to the temperature of the heating portion 22. Therefore, the temperatures of the working fluids flowing into the compression chamber 18 from the cooling portions 24 are equal to each other. Consequently, the Stirling engine 10 can increase the output torque.

Rather than adjust the length of the regenerative portions, the diameter of each of the regenerative portions 23 may be adjusted according to the temperature of the working fluid flowing in the corresponding heating portion 22. That is, the higher the temperature of the heating portion 22, the larger the diameter of the regenerative portion 23. Furthermore, the above structure of the invention can be applied to a displacer-type Stirling engine and a double acting-type Stirling engine. Additionally, the measurements or dimensions of each of the cooling portions may be adjusted instead of that of each of the regenerative portions.

While the invention has been particularly shown and described with reference to preferred embodiment thereof, it will be understood by those skilled in the art that the foregoing and other changes in form and details can be made without departing from the spirit and scope of the invention.

What is claimed is:

1. A Stirling engine comprising:

an expansion cylinder;

a compression cylinder;

a plurality of conduits for receiving a working fluid, each conduit extending between and connecting the expansion cylinder and the compression cylinder;

a plurality of heating portions each heating portion being disposed in one of the conduits and being connected with the expansion cylinder;

a plurality of cooling portions, each cooling portion being disposed in one of the conduits and being connected with the compression cylinder; and a plurality of regenerative portions, each regenerative portion being disposed in one of the conduits and connecting a corresponding heating portion to one of the cooling portions, each of the regenerative portions having a dimension that is adjusted according to a temperature of the working fluid in the corresponding heating portion.

2. A Stirling engine as recited in claim 1, wherein each of the regenerative portions possesses a length according to a temperature of the working fluid in the corresponding heating portion.

3. A Stirling engine as recited in claim 2, wherein each of the regenerative portions includes a mesh disposed therein.

4. A Stirling engine as recited in claim 2, wherein each of the regenerative portions includes a plurality of tubes disposed therein.

5. A Stirling engine as recited in claim 2, wherein each of the cooling portions includes a plurality of inwardly extending fins disposed therein.

6. A Stirling engine comprising:

an expansion cylinder having a piston disposed therein for defining an expansion chamber;

a compression chamber having a piston disposed therein for defining a compression chamber;

a plurality of hollow conduits for receiving a working fluid, said conduits extending between and connecting the expansion chamber to the compression chamber, each conduit including a heating portion connected to the expansion chamber, a cooling portion connected to the compression chamber and a regenerative portion disposed between the heating portion and the cooling portion, the regenerative portion of at least one of the conduits having a dimension that is less than a corresponding dimension of the regenerative portions of the other conduits.

7. A Stirling engine according to claim 6, including a heating device for heating working fluid disposed in the heating portion of the conduits, said heating device being positioned closer to the heating portion in said at least one conduit than to the heating portions in the other conduit.

8. A Stirling engine according to claim 6, including a mesh which extends between ends of the regenerative portion of each conduit.

9. A Stirling engine according to claim 6, including a plurality of tubes extending between ends of the regenerative portion of each conduit.

10. A Stirling engine according to claim 8, wherein each cooling portion has cooling fins extending inwardly from an inner surface of the conduit.

11. A Stirling engine according to claim 9, wherein each cooling portion has cooling fins extending inwardly from an inner surface of the conduit.

12. A Stirling engine according to claim 6, wherein the regenerative portion of the one conduit possesses a length that is less than the length of the regenerative portions of the other conduits.

* * * * *